United States Patent [19]

Hoffa

[11] 4,090,263

[45] May 16, 1978

[54] MAGNETIC MIXING APPARATUS

[75] Inventor: Jack L. Hoffa, Brea, Calif.

[73] Assignee: Beckman Instruments, Inc., Fullerton, Calif.

[21] Appl. No.: 782,583

[22] Filed: Mar. 29, 1977

Related U.S. Application Data

[63] Continuation of Ser. No. 554,024, Feb. 28, 1975, abandoned.

[51] Int. Cl.[2] ..... B01F 7/02

[52] U.S. Cl. ..... 366/273; 366/278

[58] Field of Search ..... 259/99, 100, 101, 102, 259/DIG. 46, 114, 112, 117, 20, 38, 62, 63

[56] References Cited

U.S. PATENT DOCUMENTS

| | | | |
|---|---|---|---|
| 2,466,468 | 4/1949 | Neal | 259/DIG. 46 |
| 3,088,716 | 5/1963 | Stott | 259/144 |
| 3,356,346 | 12/1967 | Landsberger | 259/DIG. 46 |
| 3,784,170 | 1/1974 | Petersen | 259/65 |
| 3,907,258 | 9/1975 | Spaziani | 259/DIG. 46 |

FOREIGN PATENT DOCUMENTS

| | | | |
|---|---|---|---|
| 1,151,246 | 7/1963 | Germany | 259/DIG. 46 |

*Primary Examiner*—Robert W. Jenkins

*Attorney, Agent, or Firm*—Robert J. Steinmeyer; Robert R. Meads; John R. Shewmaker

[57] ABSTRACT

Apparatus for mixing sample materials such as biological fluids within a mixing chamber including a magnetic mixing element within the chamber having a length greater than the chamber diameter and a rotating bar magnet positioned outside of the chamber and magnetically coupled to the mixing element for rotationally reciprocating the mixing element about an axis of rotation substantially normal to a plane including the mixing element.

4 Claims, 11 Drawing Figures

MAGNETIC MIXING APPARATUS

This is a continuation, of application Ser. No. 554,024, filed Feb. 28, 1975, now abandoned.

BACKGROUND OF THE INVENTION

1. Field of the Invention

This invention relates to mixing apparatus and, more particularly, to mixers of the type having magnetically driven mixing elements.

2. Description of the Prior Art

In the analysis of samples comprising various mixtures of fluids such as blood, serum, reagents, and the like, it has been common practice to employ permanent magnet bars, discs, pellets, etc., which are inserted into a sample cell chamber containing the materials to be mixed and which are rotated by magnetic means outside of the sample chamber for mixing the materials therein. While magnetic mixers have been widely adopted, they have not proven entirely satisfactory in all applications and particularly in the mixing of fluids having different viscosities. In this regard, because of viscosity differences some serums, for example, will float while others will sink when added to various reagents to form fluid layers within the sample chamber. As a result, extremely thorough mixing action throughout the entire chamber volume is required for such materials. This is especially true when using small volume, narrow sample cells, generally of rectangular cross-section, which utilize small sample quantities. With small quantities, thorough mixing even into the upper corners of the cell remote from the magnetic mixing bar is essential. This degree of mixing action is difficult to achieve in prior magnetic mixers since the magnetic mixing elements thereof are generally rotated continuously which establishes uniform flow patterns in the sample chamber which do not thoroughly mix the sample in its entirety.

SUMMARY OF THE INVENTION

The present invention resides in a new and improved mixing apparatus which overcomes the disadvantages of the prior mixers to provide superior mixing action and which achieves this improved mixing in a commercially practical form which is simple and inexpensive in construction and reliable in operation.

To this end, the mixing apparatus of the invention contemplates a chamber receiving a magnetic mixing element, and magnetic means outside of the chamber and magnetically coupled to the mixing element for rotationally reciprocating the mixing element within the chamber about an axis of rotation substantially normal to a plane including the mixing element. in a preferred form, by way of example only, the mixing element comprises a magnet having a magnetic axis between two opposite poles thereof with the axis of rotation thereof being substantially normal to the magnetic axis. The mixing element is preferably longer than the diameter of the mixing chamber, whereby the element abuts the interior wall of the chamber in first and second positions during reciprocation thereof to establish first and second limit positions of reciprocation. The magnetic means for rotationally reciprocating the mixing element between its limit positions may include a continuously rotating magnet outside of the chamber. So arranged, the interior wall and the magnetic means cooperate to provide an irregularity in the rotational reciprocation of the mixing element by establishing a dwell time in one limit position greater than the dwell time in the other limit position.

Figure 3:
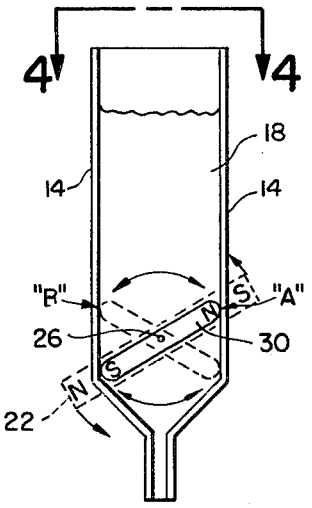
FIG. 3 is a cross-sectional view, taken in a generally vertical plane, of the mixing apparatus of the present invention and illustrates first and second positions of the magnetic mixing element therein.

FIGS. *6a–6f* are fragmentary, cross-sectional views of the mixing apparatus of FIG. 3 and progressively illustrate the rotational reciprocation of the magnetic mixing element thereof in response to rotation of the drive magnet outside of the mixing chamber.

DESCRIPTION OF THE PREFERRED EMBODIMENT

Figure 2:
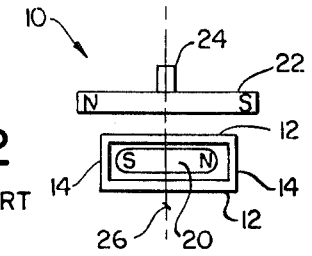
FIG. 2 PRIOR ART
FIG. 2 is a top plan view, taken generally on line 2—2, of the mixing apparatus of FIG. 1.
Figure 4:
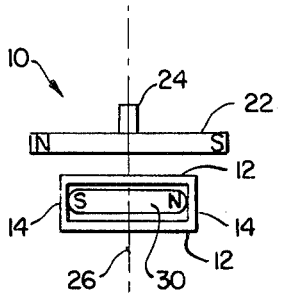
FIG. 4 is a top plan view, taken on line 4—4, of the mixing apparatus of FIG. 3.
Figure 1:
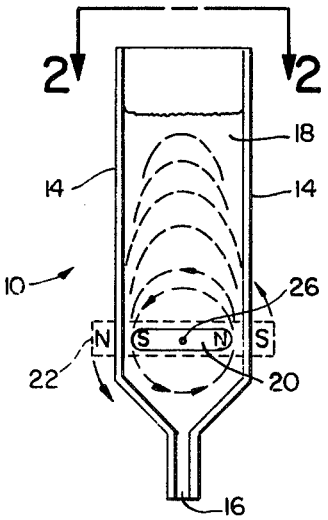
FIG. 1 PRIOR ART
FIG. 1 is a cross-sectional view, taken in a generally vertical plane, through a prior art magnetic mixing apparatus.

FIGS. 1–2 depict a prior commercial mixing apparatus which is included herein to illustrate by comparison the superior mixing qualities of apparatus of the present invention. The prior mixer is of the general form illustrated in U.S. Pat. No. 3,784,170 assigned to the assignee of the present application. The mixer comprises a sample cell, indicated generally by numeral 10, formed preferably of radiation permeable material such as quartz, pyrex glass, etc. The cell is of a generally rectangular configuration, as illustrated in FIG. 2, and includes closely spaced, parallel side walls 12 connected by parallel end walls 14 which together define a sample mixing chamber. The cell includes a port 16 at its lower end through which sample materials to be mixed are introduced into and withdrawn from the mixing chamber. The sample material within the chamber is indicated generally by numeral 18.

A magnetic mixing element 20 in the form of a permanent bar magnet is positioned for rotation within the mixing chamber. The ends of the mixing element define north-south magnetic poles, as shown, and a magnetic axis of the element extends between the two poles. A drive magnet 22 in the form of a permanent magnet bar having north-south magnetic poles, as shown, and a magnetic axis therebetween, is positioned outside of the mixing chamber and is connected to the drive shaft 24 of a motor (not shown). The drive magnet is positioned sufficiently close to the cell 10 as to be magnetically coupled to the mixing element 20. As a result, rotation of the drive magnet rotates the mixing element continuously about an axis of rotation 26 substantially normal to the magnetic axis of the mixing element. The drive magnet 22 is displaced vertically upward from the bottom of the mixing chamber a distance sufficient to position the axis of rotation 26 of the mixing element at a level permitting continuous rotation by the mixing element without striking the bottom of the chamber.

The continuous rotation of the magnetic mixing element 20 creates uniform flow patterns within the mixing chamber, as illustrated diagramatically in FIG. 1 by the dashed lines arcing upwardly in the chamber from the mixing element. As previously discussed, in many applications such uniform flow patterns do not provide sufficient mixing action throughout the mixing chamber and particularly in the upper corners thereof.

The present invention, as shown in FIGS. 3-6, in which similar parts are labeled as in FIGS. 1 and 2, is embodied in mixing apparatus which provides superior mixing action throughout the entire volume of the mixing chamber. To this end, the mixing apparatus of FIG. 3 includes a magnetic mixing element 30, illustrated as a permanent magnet having north-south poles, as shown, and a magnetic axis extending between the poles, and which has a length greater than the inside diameter of the sample cell between end walls 14. It will be understood that mixing element 30 need not be a permanent magnet and may simply comprise a material, such as iron, which can be magnetically coupled to the drive magnet 22, though this latter form would require a stronger drive magnet 22.

In accordance with an important aspect of the invention the mixing element 30 is rotationally reciprocated about the axis of rotation 26 which is substantially normal to a plane including the mixing element and preferably substantially normal to the magnetic axis of the mixing element. Because of its length, the mixing element 30 abuts the end walls 14 of the mixing chamber in first and second positions identified in FIG. 3 as positions "A" and "B", respectively, with the mixing element illustrated in dashed outline in position "B". The extent of rotation by the mixing element is, in effect, defined by positions "A" and "B" which thereby establish the limits of rotational reciprocation of the mixing element. In accordance with another important aspect of the present invention, the rotational reciprocation of the mixing element between positions "A" and "B" is provided by continuous rotation of the drive magnet 22.

Figure 6A:
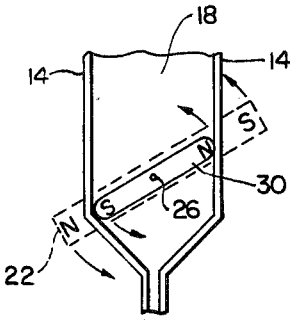
Figure 6B:
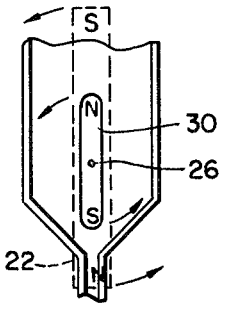
Figure 6C:
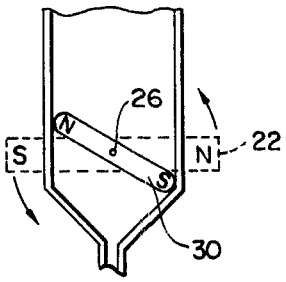

The rotational reciprocation of the mixing element 30 is illustrated progressively in FIGS. 6*a*-6*f* in response to rotation of drive magnet 22. FIG. 6*a* illustrates the beginning of a cycle arbitrarily at position "A" with opposing poles of the mixing element 30 and the drive magnet 22 aligned to establish magnetic attraction between the mixing element and the drive magnet. Counterclockwise rotation of the drive magnet 22 is assumed. FIG. 6*b* illustrates partial counterclockwise movement with elements 22 and 30 vertically aligned. Drive magnet 22 continues rotation and in FIG. 6*c* the mixing element 30 has reached position "B" in which position the walls 14 of the chamber prevent further rotation of the mixing element. In FIG. 6*c* drive magnet 22 is illustrated having rotated slightly past position "B" in which position the opposite poles of elements 22 and 30 still attract to hold the mixing element in position "B".

Figure 6D:
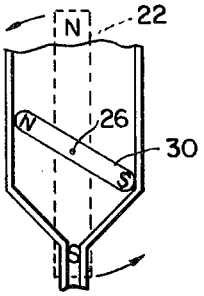

In FIG. 6*d*, magnet 22 after further rotation is illustrated vertically aligned with its south pole directed downwardly in which position the poles of the two elements 22 and 30 repel but in a direction to still maintain mixing element 30 in position "B".

Figure 6E:
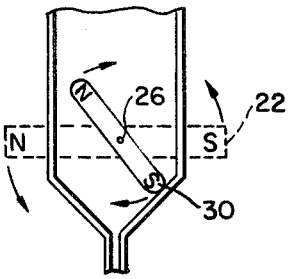
Figure 6F:
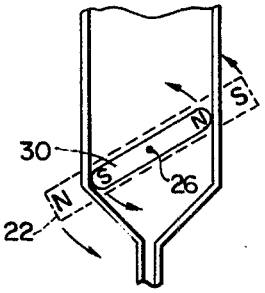

Drive magnet 22 continues rotation until like poles of the elements 22 and 30 are aligned, and FIG. 6*e* illustrates the drive magnet having rotated slightly past this aligned position. In FIG. 6*e* the repulsion between the like poles repels the mixing element 30 in clockwise direction rotating it clockwise back toward position "A". As drive magnet 22 continues in a counterclockwise direction, the opposing poles of the elements 22 and 30 attract one another to reinforce clockwise rotation of the mixing element back toward position "A". At the end of one revolution of the drive magnet, the elements assume the position of FIG. 6*f* which corresponds to the beginning of the cycle in FIG. 6*a*. It will be noted that the dwell time in position "B" exceeds the dwell time in position "A" thereby establishing an irregularity in the rotational reciprocation of the mixing element. Drive magnet 22 continues its counterclockwise rotation and continuously rotates in this manner to rotationally reciprocate the mixing element 30 between its first and second limit positions of rotation.

Figure 5:
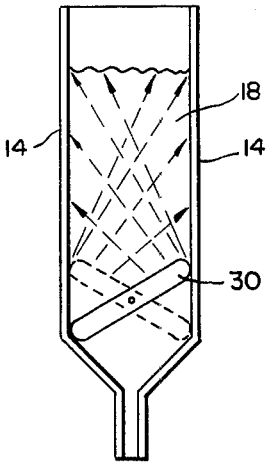
FIG. 5 is a cross-sectional view, similar to FIG. 3, of the mixing apparatus of the invention and illustrates the superior mixing action achieved thereby.

FIG. 5 illustrates the mixing action achieved by the mixing element 30 providing random and increased velocity mixing patterns extending vertically upward in the mixing chamber to the upper corners thereof. As a result, the materials to be mixed, including materials of different viscosities if utilized, are thoroughly mixed by the rotational reciprocation of the mixing element.

From the foregoing it will be apparent that the present invention provides new and improved mixing apparatus which provides a high degree of mixing action in a form which is simple in construction and reliable in operation. The mixing element 30 is rotationally reciprocated in a manner which thoroughly mixes the entire volume of materials within the mixing chamber. Moreover, it will be apparent that while a preferred form of the invention has been shown and described, various modifications may be made thereto without departing from the spirit and scope of the invention as defined in the appended claims.

I claim:

1. Mixing apparatus comprising:

a chamber for receiving materials to be mixed;

a magnetic mixing element positioned in the chamber and adapted to rotationally reciprocate about an axis of rotation;

limit means for limiting said rotational reciprocation of the mixing element to a fraction of a revolution between first and second limit positions of reciprocation and including first and second interior surfaces of the chamber spaced laterally from the axis of rotation of the mixing element to engage the mixing element in said limit positions;

magnetic means positioned outside of the chamber for producing a rotating magnetic field which is magnetically coupled to the mixing element and which rotates in one direction about said axis; and said limit means cooperating with the rotation of said magnetic field in one direction to momentarily halt and redirect rotation of said mixing element at said limit positions and to establish a dwell time for said mixing element in the limit position attained after rotation of said mixing element in said one direction which exceeds the dwell time in the limit position attained after rotation in a direction opposite to said one direction thereby providing irregular rotational reciprocation of said mixing element between said limit positions.

2. The mixing apparatus of claim 1 wherein the magnetic means comprises a rotating permanent magnet driven in said one direction for reciprocating the mixing element between said first and second limit positions.

3. Mixing apparatus comprising:

a chamber defined between a pair of substantially parallel spaced side walls and a pair of spaced end walls;

a magnetic mixing element positioned in the chamber having a magnetic axis thereof disposed generally parallel to the side walls, said mixing element being adapted to rotationally reciprocate about an axis of rotation generally normal to said side walls, and a dimension of the mixing element in the plane of rotation exceeding the spacing of the end walls of the chamber whereby the mixing element abuts the end walls in different first and second rotational positions to establish first and second limit positions of reciprocation for the mixing element;

magnetic means positioned outside of the chamber for producing a rotating magnetic field which is magnetically coupled to the mixing element and which rotates in one direction about said axis of rotation for rotationally reciprocating the mixing element a fraction of a revolution about the same axis of rotation with the plane of rotation of the mixing element generally parallel to said side walls; and said end walls cooperating with the magnetic field rotating in said one direction to momentarily halt and redirect rotation of said mixing element at said limit positions and to establish a dwell time for said mixing element in the limit position attained after rotation of said mixing element in said one direction which exceeds the dwell time in the limit position attained after rotation in a direction opposite to said one direction thereby providing irregular rotational reciprocation of said mixing element between said limit positions.

4. The mixing apparatus of claim 3 wherein the magnetic means comprises a rotating permanent magnet disposed in substantially parallel relation to the side walls and driven in said one direction in a plane of rotation substantially parallel to said side walls.

* * * * *